United States Patent [19]

Giffard

[11] Patent Number: 4,795,553

[45] Date of Patent: Jan. 3, 1989

[54] SPIRAL SEPARATOR

[75] Inventor: Philip J. Giffard, Nerang, Australia

[73] Assignee: Mineral Deposits Limited, Australia

[21] Appl. No.: 444,896

[22] PCT Filed: Mar. 25, 1982

[86] PCT No.: PCT/AU82/00040

§ 371 Date: Nov. 17, 1982

§ 102(e) Date: Nov. 17, 1982

[87] PCT Pub. No.: WO82/03343

PCT Pub. Date: Oct. 14, 1982

[30] Foreign Application Priority Data

Mar. 26, 1981 [AU] Australia ..... PE8165

[51] Int. Cl.[4] ..... B03B 5/52

[52] U.S. Cl. ..... 209/459; 209/493; 209/497

[58] Field of Search ..... 209/459, 656, 657, 696, 209/697, 157, 208, 490, 491, 493, 497–499

[56] References Cited

U.S. PATENT DOCUMENTS

| | | | |
|---|---|---|---|
| 923,988 | 6/1909 | Mullen | 209/493 |
| 1,040,374 | 10/1912 | Middleton et al. | 209/697 |
| 1,516,926 | 11/1924 | Pardee | 209/697 |
| 1,573,035 | 2/1926 | Blatch | 209/697 X |
| 1,698,101 | 1/1929 | Martling | 209/211 |
| 1,880,185 | 9/1932 | Kerns et al. | 209/211 |
| 1,959,736 | 5/1934 | Rademacher | 209/697 |
| 2,425,110 | 8/1947 | McCurdy | 210/512.1 |
| 2,431,559 | 11/1947 | Humphreys | 209/211 |
| 2,431,560 | 11/1947 | Humphreys | 209/211 |
| 2,615,572 | 10/1952 | Hodge | 209/211 |
| 2,700,469 | 1/1955 | Humphreys | 209/211 |
| 2,724,498 | 11/1955 | Beresford | 209/697 |
| 3,099,621 | 7/1963 | Close | 209/459 |
| 3,319,788 | 5/1967 | Reichert | 209/493 |
| 3,371,784 | 3/1968 | Conway | 209/458 |
| 3,568,832 | 3/1971 | Persson | 209/459 |
| 3,910,835 | 10/1975 | Stafford | 209/697 |
| 4,059,506 | 11/1977 | Bryson | 209/18 |
| 4,142,965 | 3/1979 | Dolan | 209/487 |
| 4,146,137 | 3/1979 | Beckham | 209/696 |
| 4,189,378 | 2/1980 | Wright et al. | 209/459 |
| 4,277,330 | 7/1981 | Wright et al. | 209/459 |
| 4,384,650 | 5/1983 | Wright | 209/697 |

FOREIGN PATENT DOCUMENTS

| | | | |
|---|---|---|---|
| 35795/71 | 5/1973 | Australia . | |
| 37175/78 | 12/1979 | Australia . | |
| 30815/77 | 12/1979 | Australia . | |
| 33132/78 | 10/1980 | Australia . | |
| 74297/81 | 8/1981 | Australia . | |
| 1132511 | 7/1962 | Fed. Rep. of Germany . | |
| 255312 | 7/1926 | United Kingdom . | |
| 2046131 | 11/1980 | United Kingdom | 209/459 |

*Primary Examiner*—Robert B. Reeves
*Assistant Examiner*—Edward M. Wacyra
*Attorney, Agent, or Firm*—Stevens, Davis, Miller & Mosher

[57] ABSTRACT

In a spiral separator of the kind used for the wet gravity separation of solids (Figs. 5 & 6) there are provided splitters (70,71,72) in vertically aligned troughs (20,21,22) which are operatively connected by a linkage (80) permitting adjustment of splitters in unison. Preferably the splitters are at corresponding locations of separate troughs and are in vertical register.

8 Claims, 7 Drawing Sheets

SPIRAL SEPARATOR

TECHNICAL FIELD

This invention relates to an improved spiral separator of particular use for the separation of minerals.

Spiral separators are extensively used for the wet gravity separation of solids according to their specific gravity, for example for separating various kinds of heavy mineral sands from silica sand.

BACKGROUND ART

Separators of the kind under discussion commonly comprise a vertical column about which there are supported one or more helical troughs coaxially nested in the manner of a multi-start screw thread. The troughs are typically but not essentially of uniform pitch throughout their length. Each trough is provided with a pulp inlet at the upper end of the working portion of the trough, the inlet being connected by tubular means with a common header tank for spiral separators operating in parallel whereby a pulp in the tank may be fed to each inlet. When more than one trough is supported by the column, the respective pulp inlets of the troughs are commonly arranged as nearly as possible to be in a horizontal plane to facilitate simultaneous introduction of pulp to each helix. In the case of two troughs supported on a column the inlets are typically diametrically opposite each other and in the case of the three troughs are equiangularly spaced in a horizontal plane.

Each trough has a floor situated between an outer trough wall and an inner trough wall. In some separators the column may be, or may be a part of, the inner wall wall. In cross-section, with respect to the helix radial direction, the bottom working portion of the trough floor generally inclines upwardly from the inner wall or column to the outer wall. It will be understood that the trough floor at its radially innermost end curves upward to blend with the inner wall or column and at its radially outermost end curves radially upwards to blend with the outer wall.

In operation, pulp is fed from the header to the inlet of each trough. As the stream of pulp descends the trough, particles of higher specific gravity tend to segregate to the bottom of the stream and then slow through contact with the surface and gravitate radially inwardly while particles of lighter specific gravity tend to move radially outwards by virtue of centrifugal forces which overcome the inwards gravitational component. Splitters are arranged at variuus levels of each trough whereby each descending stream may be split into fractions and desired fractions are withdrawn at outlets associated with the splitters. The setting of the splitters requires supervision and frequent readjustment during use of the apparatus in order to maintain acceptable yields.

An object of the present invention is to provide a trough separator which in preferred embodiments is simpler to operate and produces a higher yield of desired fractions than those known in the prior art.

DISCLOSURE OF THE INVENTION

According to one aspect the invention consists in a spiral separator of the kind used for the wet gravity separation of solids and being characterized in that at least two splitters thereof are operatively connected by linkage means whereby the splitters may be operated in unison.

In preferred embodiments the separator has at least two helical troughs which are substantially identical to each other over a working portion, pulp introduction means whereby pulp is introduced to each trough at a location of one substantially in vertical register with that of the other, an adjustable splitter in each trough, the splitter of one trough corresponding in location to the splitter of the other, and connecting means for adjusting the setting of the splitters in unison. Preferably also the splitters are disposed in vertical register.

By corresponding in location is meant a location at a corresponding distance along the trough from the introduction means and at a corresponding radial distance from the helix axis.

BRIEF DESCRIPTION OF THE DRAWINGS

An embodiment of the invention will now be described by way of example only with reference to the accompanying drawings wherein.

DESCRIPTION OF PREFERRED EMBODIMENTS

Figure 1:
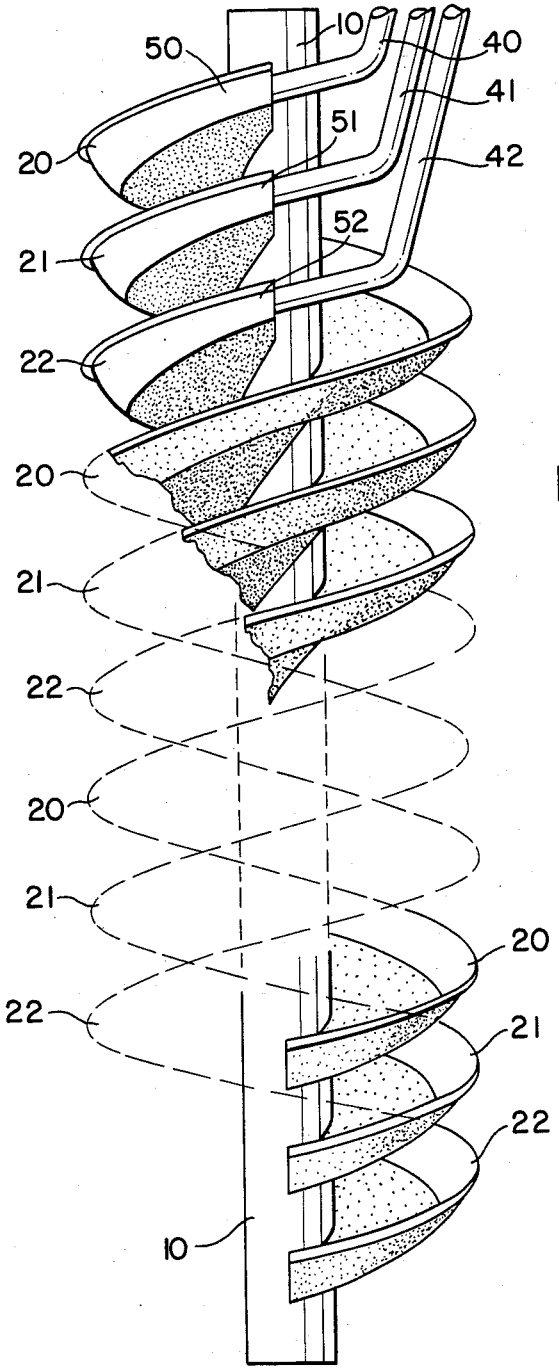
FIG. 1 shows the general arrangement of a three trough separator according to the invention
Figure 2A:
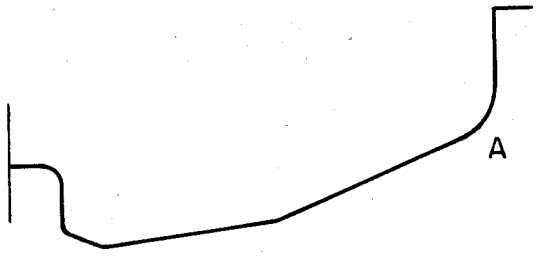
FIGS. 2A–2D show radial cross sections taken respectively at differing altitudes of one spiral of the separator of FIG. 1.
Figure 2B:
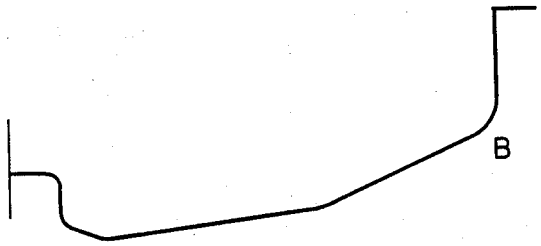
Figure 2C:
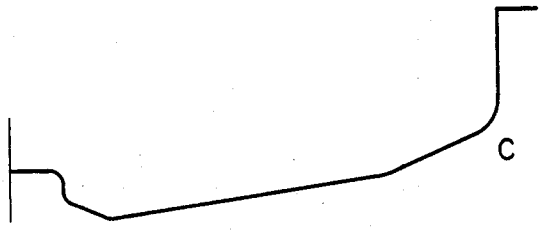
Figure 2D:
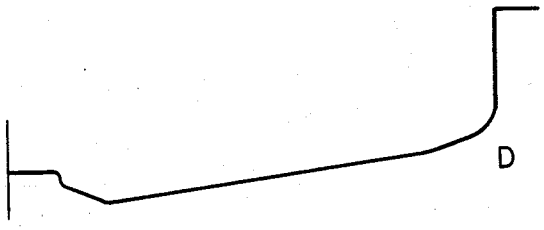
Figure 3:
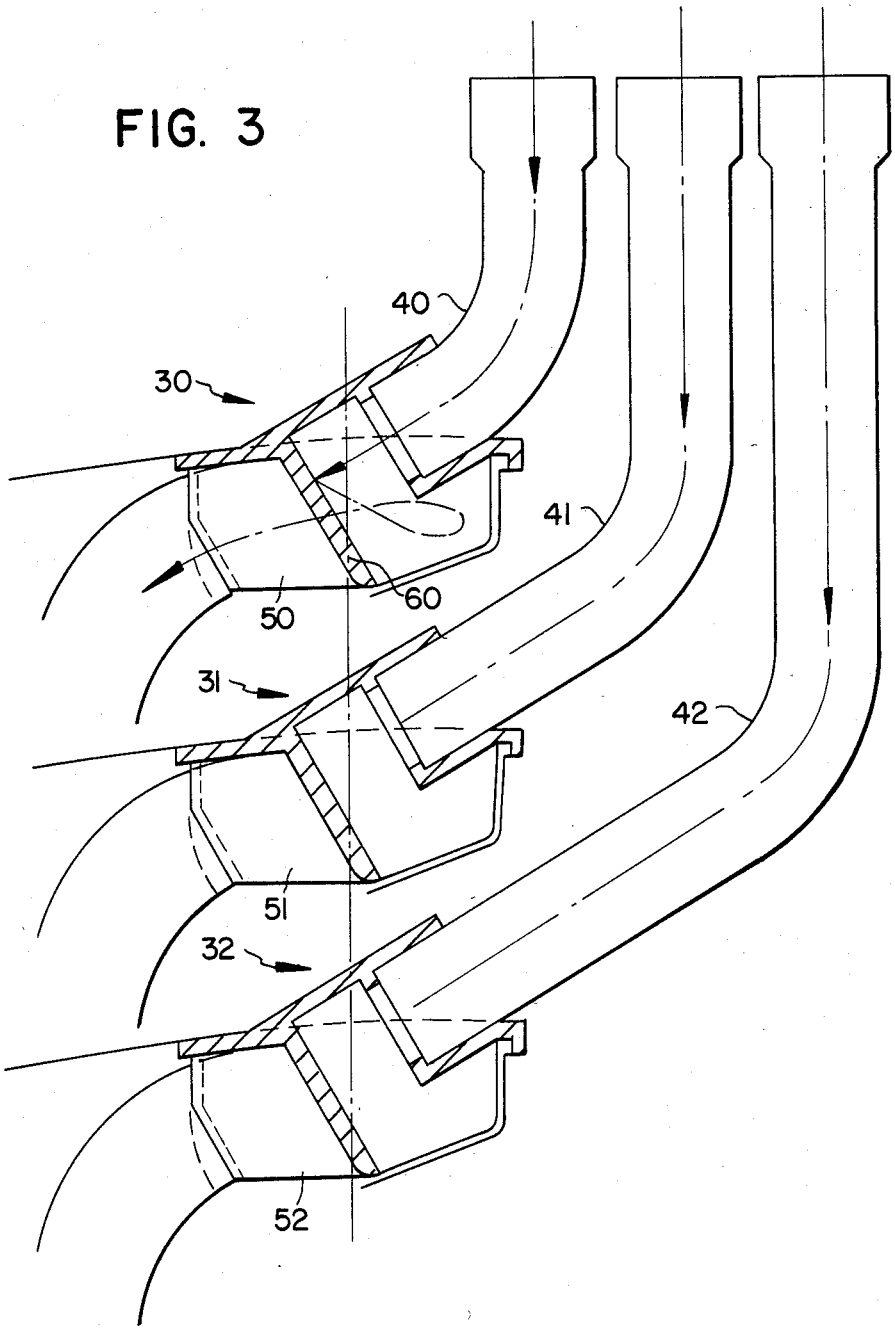
FIG. 3 is a cross-section elevation of feed box arrangements for introducing a pulp to three troughs arranged according to the invention.
Figure 4:
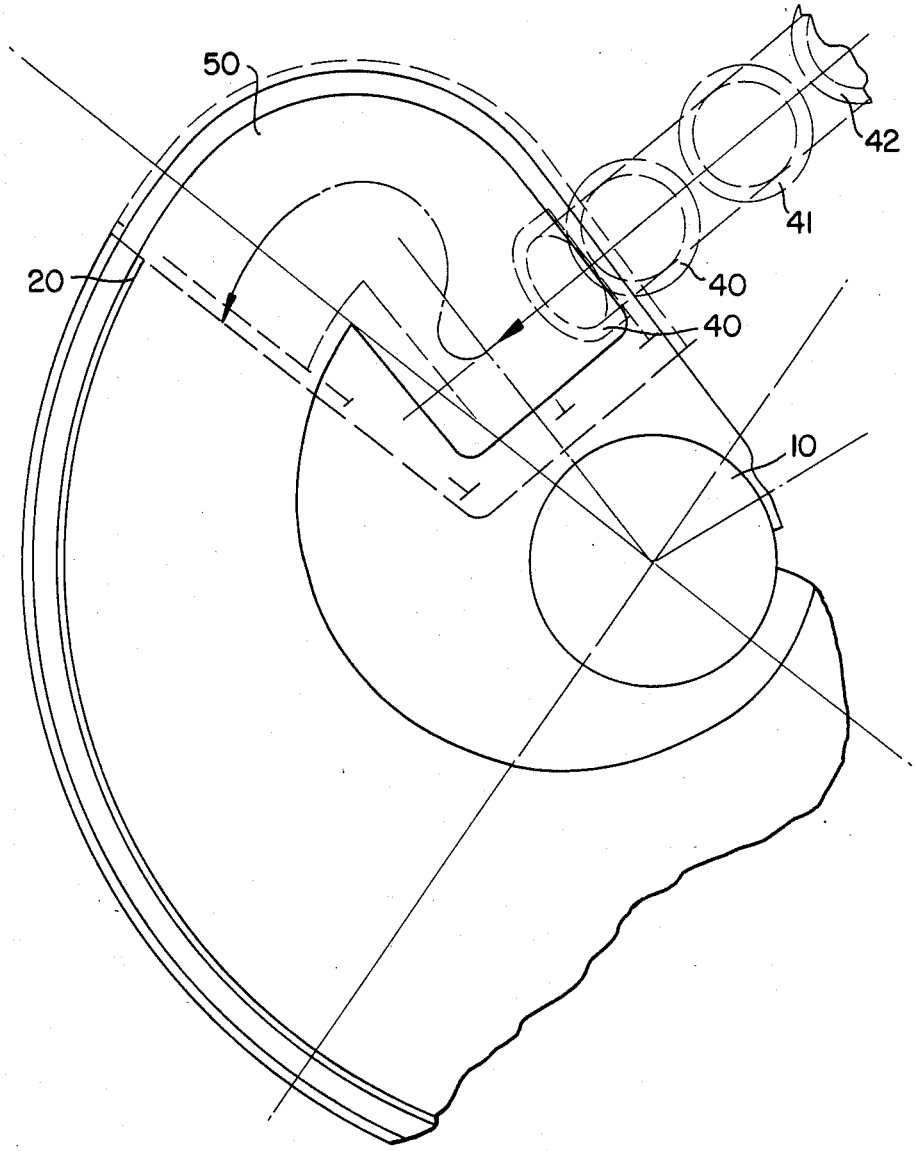
FIG. 4 shows in plan the feed box of FIG. 3.

With reference to the drawings there is shown a part of a trough separator comprising an upright column 10 supporting three helical troughs respectively 20, 21, 22. Troughs 20, 21, 22 are disposed in coaxial nested configuration spaced apart in the axial direction and each is identical to the others over a working length which descends from a pulp inlet, respectively 30, 31, 32, thereof.

Pulp inlets 30, 31, 32 are arranged substantially in vertical array, that is to say with zero radial rotation with respect to each other, and each is connected by respective tubes 40, 41, 42 with a pulp header tank or tanks not shown in the drawings.

Figure 5:
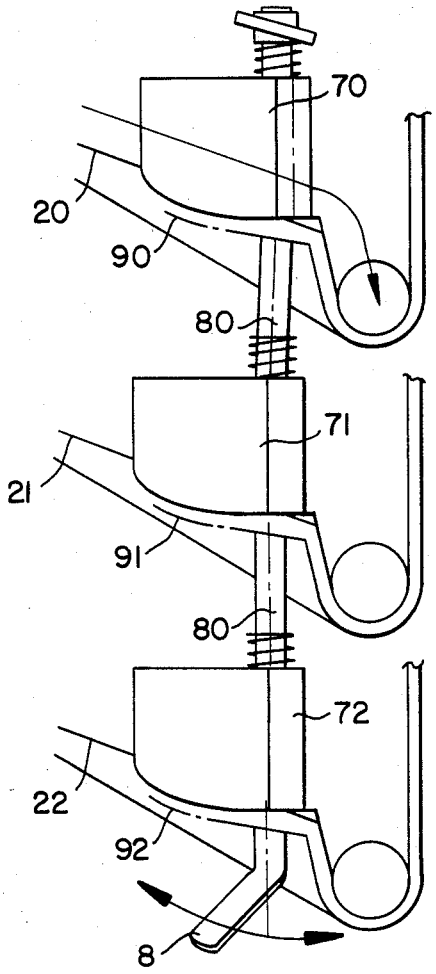
FIG. 5 is a cross-section taken in a radial direction and showing three splitters arranged in assembly.
Figure 6:
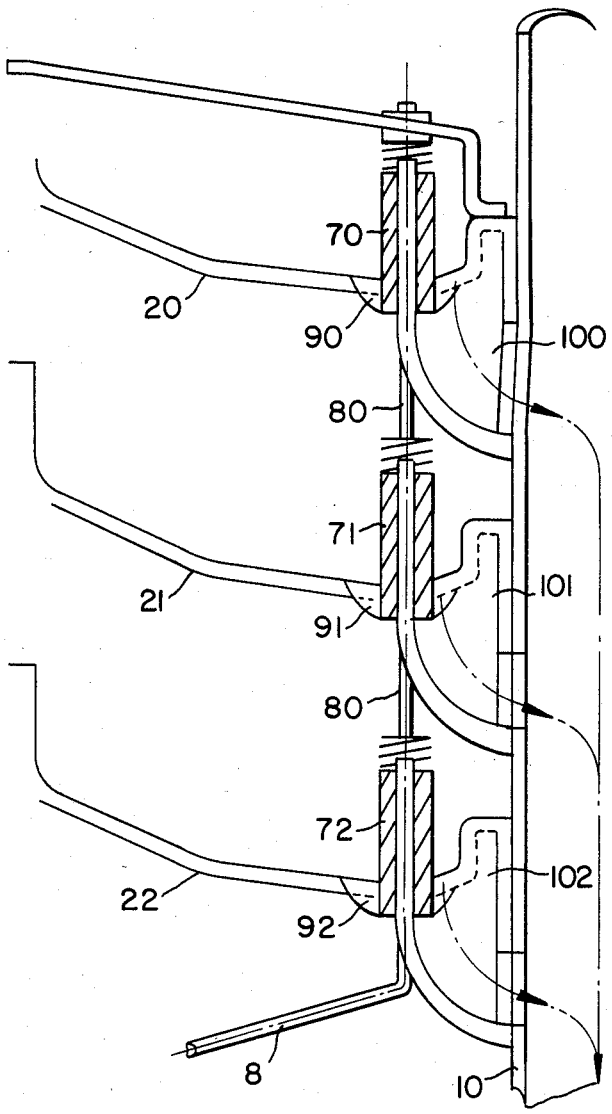
FIG. 6 shows a cross-section of the splitter assembly of FIG. 5 taken on a line perpendicular to that of FIG. 5.

With reference for example to trough 20, the feed box comprises a boil box 50 located at the upper end of the trough and extending radially inwards. Tube 40 delivers slurry into radially inward extension of boil box 50 at a shallow angle to the horizontal and in a direction substantially at right angles to the radial direction when the separator is viewed in plan. A baffle 60 at an angle to the vertical faces the mouth of tube 40 and is disposed so that the slurry fed by tube 40 impinges on baffle 60 and spills radially outwards at reduced velocity into the portion of boil box 50 at the top of the trough, from where it overflows at still lower velocity into the trough working portion. Troughs 21 and 22 are fitted with corresponding respective boil boxes 51 and 52 whereby slurry is fed from tubes 41 and 42 to the troughs thereof. The pulp is fed to each trough at substantially the same feed rate and in consequence the separation process reaches the same stage in each trough at points vertically overlying one another. Splitters are installed at points one above the other at corresponding locations of each trough and may be operated in unison. With reference to FIGS. 5 and 6, identical splitter blades 70, 71 and 72 are mounted at corresponding points of troughs 20, 21, and 22 in vertical array. Splitter blades 70, 71 and 72 are each wedged shaped in plan, having the apex pointing in a generally upstream direction and mounted for rotation in unison about a vertical axis near the downstream end of the blade by shaft 80 which extends through the troughs. For preference splitter blades 70, 71 and 72 are each seated in corresponding shallow recesses 90, 91 and 92 of the trough bottom and have the lower part of the upstream edge of the blade close to the upstream edge of the recess. The splitters may be provided with off-take conduit means 100, 101, 102 via supporting column 10.

Figure 7:
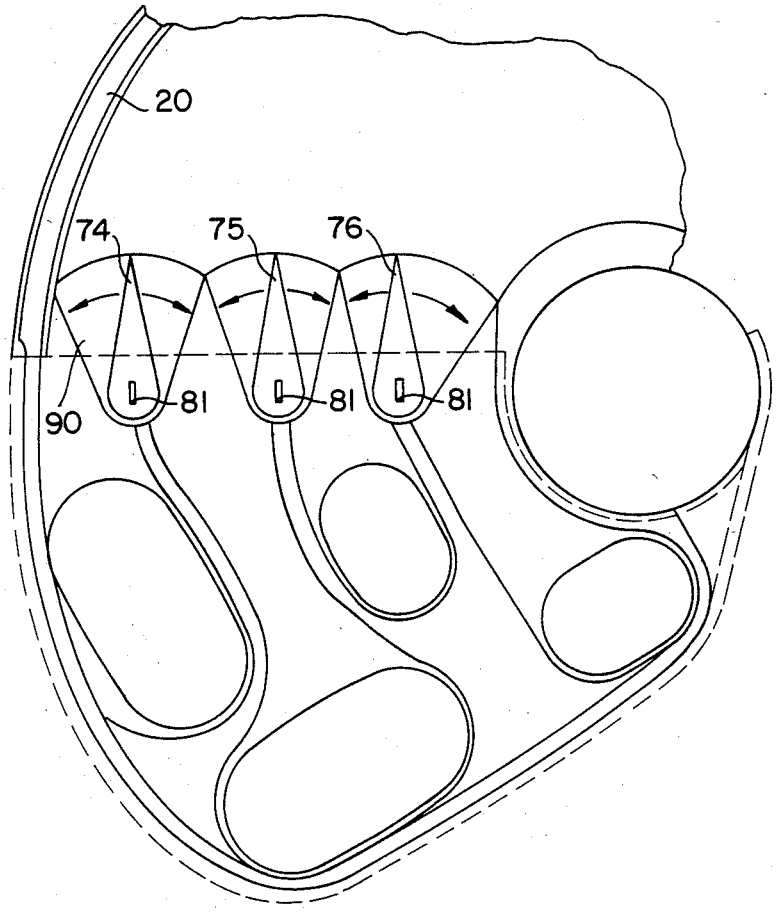
FIG. 7 shows a bottom splitter assembly in plan.

FIG. 7 shows a bottom splitter arrangement adapted to separate four fractions at the lower end of trough 20; corresponding bottom splitters at the lower end respectively of troughs 21 and 22 are not shown. The bottom splitter comprises three blades 74, 75, 76 each of similar shape to those shown in FIGS. 5 and 6 and similarly axially mounted by shaft 81 a depression 90. In the present example the bottom splitter blades are also ganged in vertical array. That is to say the radially outer blade is operable in unison with the corresponding underlying blade of each other trough. The radially inner blade is operable in unison with the corresponding underlying blade of each other trough, and the intermediate blades of each trough is ganged with the others. Each gang is operable independantly of each other and independantly of ganged splitters at higher levels of the apparatus.

In the present example provision is made to separate:

(1) A concentrate; which consists predominantly of higher specific gravity particles.

(2) Middlings; which include particles which may fall in specific gravity between those in the concentrates and those in the tailings or a mixture of high and low specific gravity particles which the apparatus has not succeeded in separating in concentrate or tailings.

(3) Tailings - solids fraction; which includes the bulk of the granular waste particles and some of the water.

(4) Tailings - water fraction; which includes: water not required for handling granular tailings, some granular tailings, small, high specific gravity particles, which become trapped in the high velocity water stream but may be recovered by separate treatment of the water stream.

For preference the trough bottom is of a shallow slope in the radial direction in the positions at which it is desired to install splitters, and that is greatly facilitated in a preferred embodiment by constructing the helix in accordance with the principles disclosed, in co-pending U.S. application Ser. No. 06/444,895, now U.S. Pat. No. 4,476,980 the subject matter of which is incorporated herein by reference. In that event the cross-section of the trough is as shown in FIGS. 2A–2D, having a substantially constant radial slope at a working portion near the column.

In the present example shaft 80 is provided with a handle 8 whereby corresponding splitters 70, 71 and 72 may be adjusted in unison but it will be understood that other linkages may be used or the splitters may be operated in unison by automatic control from a single point.

A further advantage of the apparatus is that the outlets from the various splitter streams may also be disposed in vertical array with only the bottom one requiring an external connection. This contrasts with earlier apparatus in which typically three outlets are required for each of three troughs requiring nine external hose connections per apparatus if concentrate, middlings and trailings are separated or 12 external hose connections per apparatus if the trailings are further separated into solids and water fractions.

As will be apparent to those skilled in the art from the disclosure hereof operatively interlinked splitters may also in certain circumstances be advantageously used on a single helix, for example, where working portions are arranged in series and also may be beneficial when used with a plurality of troughs which are not identical but are of related configuration. Also while vertical alignment of splitters simplifiers interlinkage, vertical registration is not essential.

I claim:

1. A spiral separator of the kind used for wet gravity separation and comprising at least two troughs in generally vertical alignment, means to introduce pulp to each trough at a location of one trough in substantially vertical register with the location of another, each trough having a splitter therein which is mounted for pivotal movement about a generally vertical axis and linkage means for operatively connecting the splitter of one trough with the splitter of another trough, said linkage means extending through at least one of said troughs.

2. Apparatus according to claim 1 wherein the troughs are substantially identical and the splitter of one trough is situated at a location which corresponds to the location of the splitter in another trough.

3. Apparatus according to claim 1 wherein the splitters of said at least two troughs are disposed in substantially vertical register.

4. Apparatus according to claim 3 wherein the splitters are connected by a vertical shaft.

5. A spiral separator according to claim 1 wherein the pulp introduction means include means for introducing the pulp to one trough at a rate which corresponds to the rate of introduction to another trough.

6. A spiral separator according to claim 5 wherein the pulp introduction means of each trough comprises a boil box extending radially inward of the trough, means for delivering pulp to the radially inwards extension at an angle to the horizontal and at an angle to the radial direction, and baffle means directing the pulp from the radially inwards extension into the trough.

7. A separator according to claim 1 further comprising interconnected discharge means.

8. The separator of claim 1 in which each splitter is a blade having a pivot point on its downstream end and an upstream end swingable in a generally horizontal plane.

* * * * *